United States Patent [19]

Murrah

[11] Patent Number: 4,990,128

[45] Date of Patent: Feb. 5, 1991

[54] CARTON END PANEL FOLDING MECHANISM

[75] Inventor: Howard E. Murrah, Fenton, Mich.

[73] Assignee: Elopak Systems A.G., Glattbrugg, Switzerland

[21] Appl. No.: 405,757

[22] Filed: Sep. 11, 1989

[51] Int. Cl.[5] ..... B31B 3/32

[52] U.S. Cl. ..... 493/133; 493/163; 493/177; 493/183

[58] Field of Search ..... 493/163, 164, 177, 178, 493/183, 184, 133

[56] References Cited

U.S. PATENT DOCUMENTS

| | | | |
|---|---|---|---|
| 3,183,801 | 5/1905 | Egleston | 493/183 |
| 3,225,666 | 12/1965 | Reimers | 493/183 |
| 3,303,761 | 2/1967 | Monroe et al. | 493/183 |
| 4,041,850 | 8/1977 | Reichert | 493/183 |
| 4,738,077 | 4/1988 | Wakabayashi et al. | 493/184 |
| 4,776,830 | 10/1988 | Fujikawa et al. | 493/164 |

*Primary Examiner*—William E. Terrell

*Attorney, Agent, or Firm*—John P. Moran

[57] ABSTRACT

A carton leading and trailing end panel folding mechanism for use with a tubular carton blank mounted on a mandrel, with the end closure panels extended beyond the face of the mandrel. The main folding mechanism is a single freely rotatable roller which serves to first fold the leading panel rearwardly as the latter rotates therepast, and then to engage and fold the trailing panel forwardly as it rotates therepast. The roller may be stationary until contacted by the leading panel.

9 Claims, 4 Drawing Sheets

FIG.6
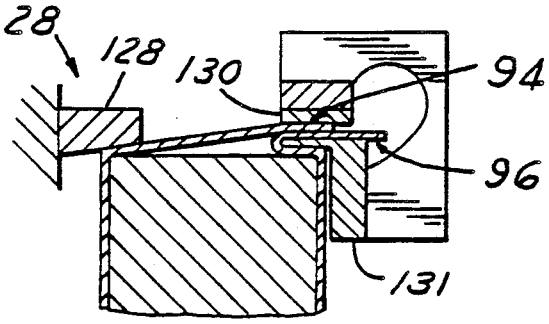
FIG.7
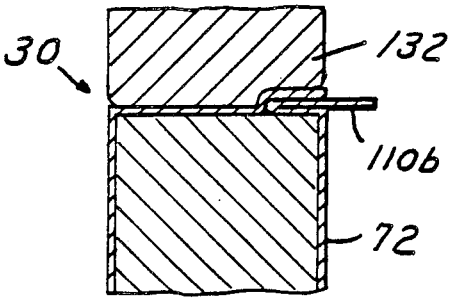
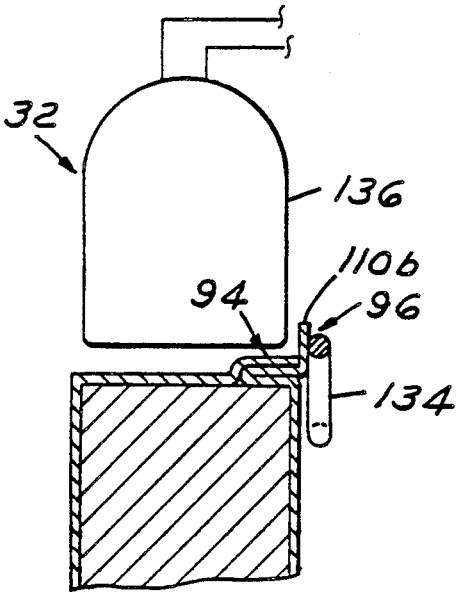
FIG.8
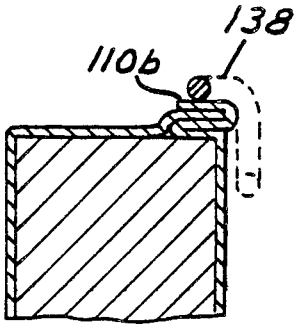
FIG.9

CARTON END PANEL FOLDING MECHANISM

TECHNICAL FIELD

This invention relates generally to forming, filling and sealing machines for thermoplastic coated paperboard cartons for liquid products, and, more particularly, to folding mechanisms for folding the leading and trailing end panels of tubular cartons mounted on conventional machine mandrels.

BACKGROUND ART

Heretofore, carton end panel folding arrangements for folding the trailing panel of moving open-ended cartons have generally involved somewhat complex structures including many different components to accomplish the folding operation.

For example, Linner 4,092,906 includes a pair of oppositely rotating pins for engaging and folding front and rear flaps extending from boxes, the pins being driven by a plurality of cooperating gear wheels.

Bombard 2,883,917 illustrates a method and apparatus for folding trailing flaps as blanks travel in a straight line path through the machine. The apparatus includes a rotatable member having circumferential flap recesses formed therein and fingers with hooks extending substantially tangentially therefrom. While the conveyor pauses, the rotating hooks engage each trailing flap in turn and folds it forwardly through the adjacent flap recess.

Eldridge 4,432,745 discloses an apparatus for folding the trailing edge of paperboard blanks wherein arms with heads formed thereon rotate relative to a conveyor carrying the blanks such that the heads, while rotating, extend through openings in the conveyor to contact the trailing flaps of the blanks and fold them forwardly onto the respective blank bodies.

Toriyama 4,629,445 employs a rotatable claw mechanism for folding a rear portion of a blank, with an associated cam mechanism for changing the angular speed of the claw mechanism.

Genoud et al 4,747,813 discloses a further rotating arm and nose portion for engaging and folding a trailing flap as a blank moves along its path.

DISCLOSURE OF THE INVENTION

A general object of the invention is to provide a simplified, yet efficient improved folding mechanism for folding the leading and trailing carton end panels of a carton mounted on a mandrel while the latter is being rotated.

Another object of the invention is to provide an improved leading and trailing carton end panel folding mechanism which is actuated upon engagement by the leading end panel.

A further object of the invention is to provide a leading and trailing carton end panel folding mechanism including a roller which is rotatably actuated upon engaging and folding the leading end panel backwardly and adaptable thereafter to engage and fold the trailing end panel forwardly while the carton is moving.

A still further object of the invention is to provide an end panel folding mechanism which is adaptable to being mounted on existing carton forming, filling and sealing machines.

These and other objects and advantages will be more apparent when reference is made to the following drawings and the accompanying description.

BRIEF DESCRIPTION OF THE DRAWINGS

FIGS. 5–9 are fragmentary end views of further portions of the FIG. 1 machine operative on the two side panels of the carton end closure.

BEST MODE FOR CARRYING OUT THE INVENTION

Figure 1:
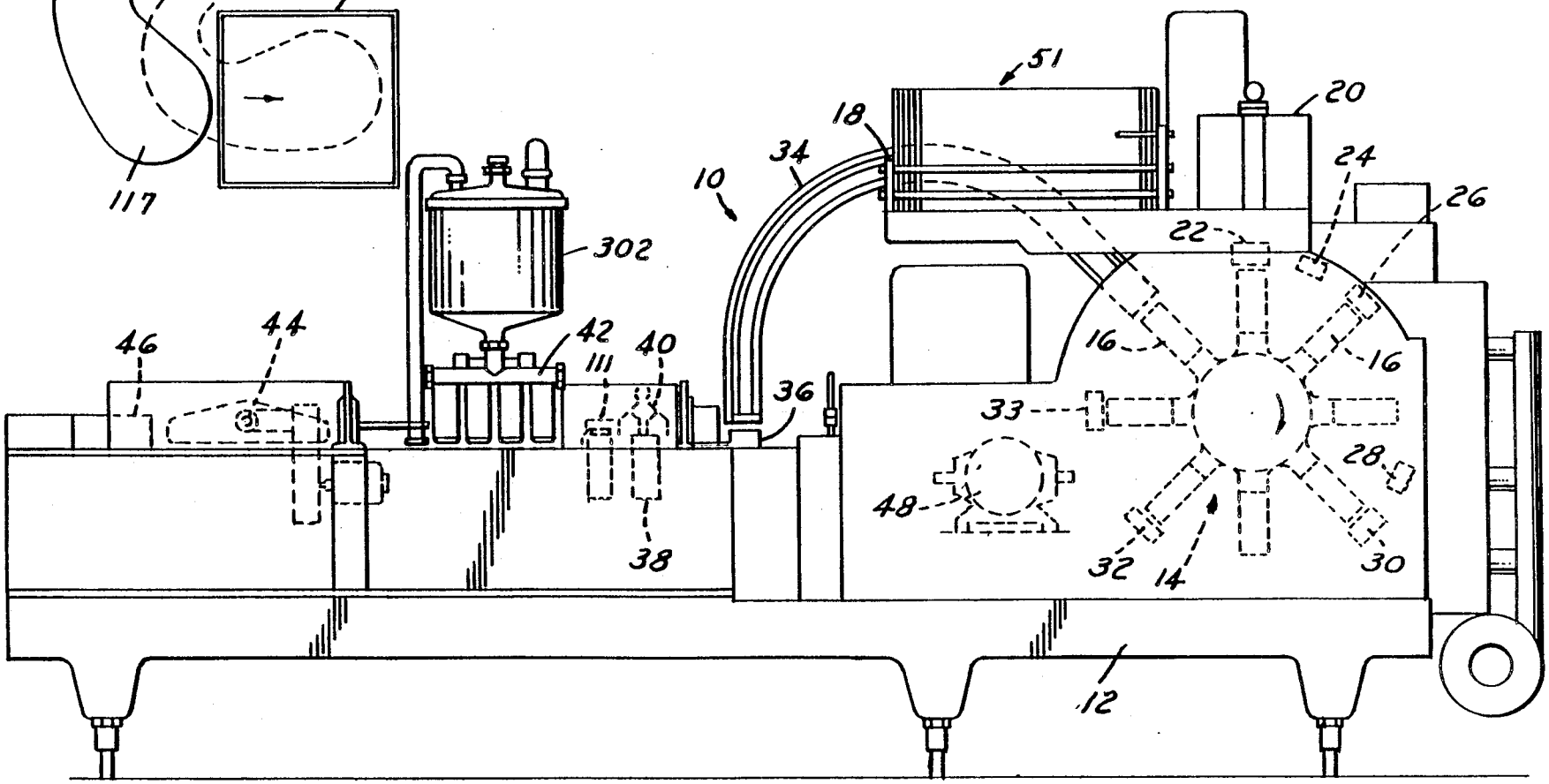
FIG. 1 is a side elevational view of a forming, filling an sealing machine embodying the invention.

Referring now to the drawings in greater detail, FIG. 1 illustrates a forming, filling and sealing machine, represented at 10, mounted on a frame 12, and including an indexible turret mechanism 14 having a plurality of radially extending square cross-section mandrels 16 formed thereon, a magazine 18 for holding a stack of thermoplastic-coated paperboard blanks (to be described), and a feeder and loading mechanism 20 adjacent the outer periphery of the turret mechanism 14 at the 12:00 o'clock position thereof.

Positioned around the periphery of the turret mechanism 14 are a plurality of cooperating station units with which the mandrels 16 are adapted to register sequentially during the course of their intermittent or indexing movement. Specifically, the station units include a prebreaker unit 22 at the 12:00 o'clock position, a leading and trailing end panel folding mechanism 24 at approximately the 1:00 o'clock position, a side panel guide mechanism 26 at approximately the 2:00 o'clock position, a side panel folding mechanism 28 at approximately the 4:00 o'clock position, sealing unit 30 at the 5:00 o'clock position, a lift tab folding and heating unit 32 at the 7:00 o'clock position, and a lift tab sealing unit 33 at the 9:00 o'clock position.

A substantially arcuate-shaped tubular trackaway 34 extends from the 10:30 o'clock position of the turret mechanism 14 to an indexible conveyor 36. The conveyor indexes open-ended containers 38 past a breaker unit 40, a filler unit 42, a heater unit 44, and a closure unit 46. Power for driving the turret mechanism 12 and conveyor 36 step-by-step indexing motion is furnished by any suitable drive mechanism (not shown) from a main drive motor, represented at 48.

Figure 4:
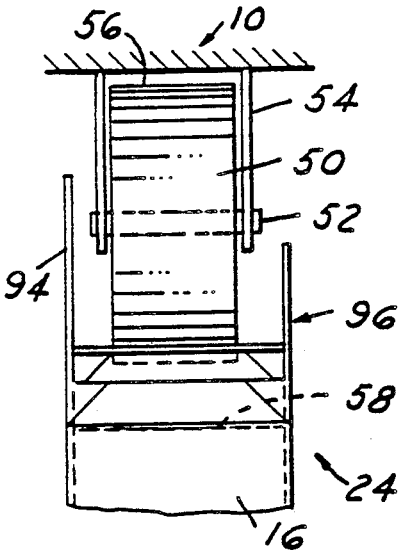
FIG. 4 is a fragmentary end view of the inventive portion of the FIG. 1 machine.

The leading and trailing end panel folding mechanism 24 comprises an elastomer coated roller 50 (FIG. 4) freely rotatably mounted on a pivot pin 52 connected between suitable support flanges 54 mounted on the machine 10 such that the outer peripheries of the roller and the mandrels 16 are a predetermine distance apart, say 0.020", at the 1:00 o'clock position of the turret mechanism 14. The width of the face 56 of the roller 50 is a predetermined amount narrower than the width of the end face 58 of the mandrel 16. For example, for the open-end carton 116 shown in FIG. 2*b*, the width of the roller face 56 is approximately equal to the distance along the free cut-edge of the leading panel 92 between the ends of the diagonal score lines 104 and 106.

Figure 2:
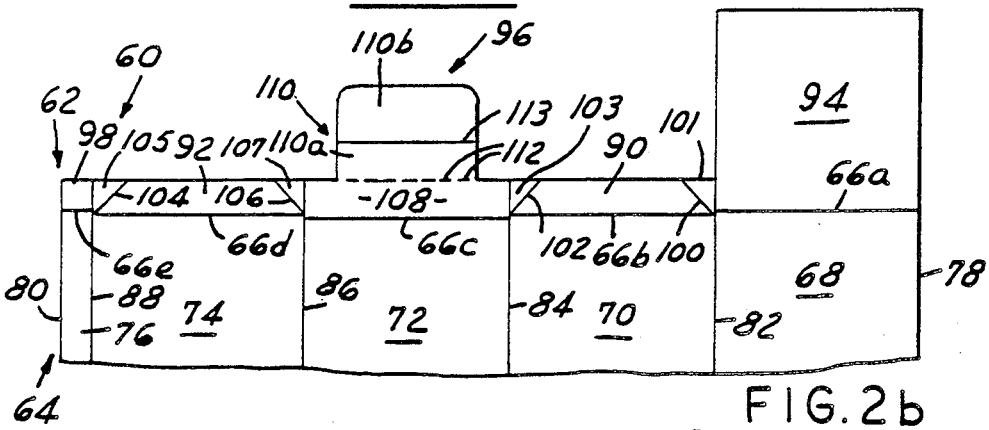
FIGS. 2 and 2*a* are fragmentary layout views of a thermoplastic coated paperboard blank processed by the invention.

While various flat end closure arrangements may be formed and sealed while mounted on the mandrels 16 of the indexible turret mechanism !4, for purposes of this disclosure, the flat end closure arrangement 60 shown in FIG. 2 has been selected to be described in conjunction with the various processing units 22, 24, 26, 28, 30, 32 and 33 positioned around the outer periphery of the turret mechanism.

An example of a further leading and trailing end closure arrangement that could be flattened by the forming units 22 and 24 is shown and described in Egleston 3,474,951. For this arrangement, the units 26, 28, 30, 32 and 33 would be different.

The container blank 60 is generally divided into three sections including one end closure 62, a body portion 64, and a second end closure (not shown). The latter may be any suitable end closure arrangement and is not a part of this invention.

More specifically, staggered top horizontal score lines 66*a*, 66*b*, 66*c*, 66*d* and 66*e* extend transversely across the container blank 60 and separate the top end closure 62 and the body portion 64. As shown in FIG. 2, score lines 66*a* and 66*e* are at the highest elevation, score lines 66*b* and 66*d* are located below the score lines 66*a* and 66*e* a distance substantially equal to the thickness of the paperboard, and the score line 66*c* is the same distance below the score lines 66*b* and 66*d*.

The body portion 64 comprises a plurality of integrally connected body panels, namely a back panel 68, a first side panel 70, a front panel 72, a second side panel 74, and a side seam flap or narrow fifth panel 76 formed adjacent the panel 74. The container blank 60 is defined on its longitudinal sides by its edges 78 and 80. The body panels 68, 70, 72 and 74, and the side seam flap 76, are defined by vertical score lines 82, 84, 86 and 88. It should be apparent that the body panels may be equal in width and, hence, adaptable to forming a square cross-section container, or may be formed such that one pair of alternate body panels is wider than the other pair and, hence, adaptable to forming a rectangular cross-section container. For cooperation with a rectangular shaped tubular blank, the mandrels 16 would, of course, be rectangular in shape also.

The top end closure 62 comprises side fold-in edge panels 90 and 92. The panels 90 and 92 are connected integrally to the upper ends of the body panel members 70 and 74, respectively. A cover panel 94 and a front edge panel 96 are connected integrally to the body panels 68 and 72, respectively. A further panel 98 is connected integrally to the upper end of the side seam flap 76. A diagonal score line 100 extends from the approximate juncture of the score lines 66*b* and 82 to the free cut edge of the panel 90, forming a triangular fold-over panel segment or corner gusset 101, while a diagonal score line 102 extends from the approximate juncture of the score lines 66*b* and 84 to the free cut edge of the panel 90, forming a substantially triangular fold-over panel segment or corner gusset 103. A diagonal score line 104 extends from the approximate juncture of the score lines 66*d* and 88 to the free cut edge of the panel 92, forming a triangular fold-over panel segment or corner gusset 105, while a diagonal score line 106 extends from the approximate juncture of the score lines 66 and 86 to the free cut edge of the panel 92, forming a substantially triangular fold-over panel segment or corner gusset 107.

The front edge panel 96 includes a fold-in segment 108 connected to the body panel 72 and a narrower segment 110 extending from the panel segment 108, with a weakened line 112, such as a perforated line or a partial cut, formed therebetween. A horizontal score line 113 is formed across the panel segment 110 at a distance from the perforations 112 approximately equal to the height of the panel segment 108, separating the segment 110 into a fold-out portion 110*a* and a fold-over portion 101*b*, the latter to become a lift tab, as will be explained.

Figure 2A:
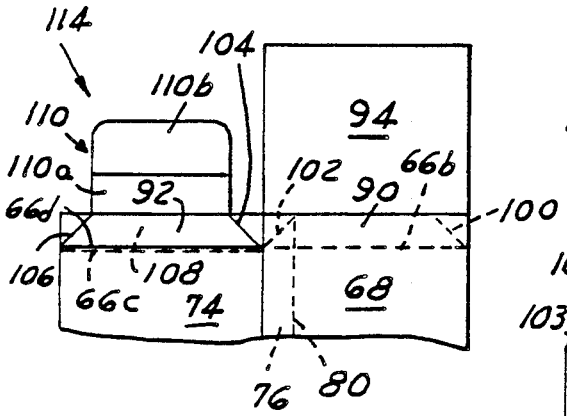
Figure 2B:
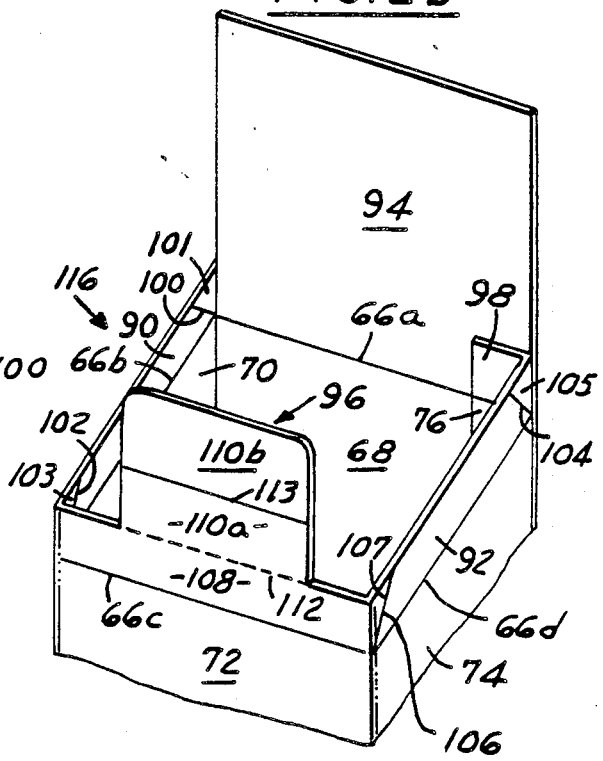
FIGS. 2*b* and 2*c* are enlarged fragmentary perspective views of the carton end closure formed from the blank of FIG. 2*a* in full open and completely closed positions, respectively.

The container blank 60 illustrated in FIG. 2 is first formed into a side-seam-sealed blank 114 (FIG. 2*a*) in a customary manner by rotating the body panel 74 and the side seam flap 76 as a unit about the vertical score line 86, and having the inside surfaces of the body panel 74 come into contact with the inside surface of the body panels 72, with the vertical score line 88 positioned next to the vertical score line 84, and with the inside surface of the side seam flap 76 contacting the inside surface of the body panel 70 adjacent the vertical score line 84. The body panel 68 is then rotated about the vertical score line 82 to bring its inside surface into contact with the inside surface of the body panel 70. The inside surface of the body panel 68 along the edge 78 comes into contact with the outside surface of the side seam flap 76, and the edge 78 is positioned parallel and aligned with the vertical score line 88. The various members of the top end closure 62 and the bottom end closure will make similar movements. The container blank 60 is then sealed where the inside area of the body panel 68 comes into contact with the outside surface of the side seam flap 76, forming the side-seam-sealed blank 114 shown in FIG. 2*a*.

In operation, the side-seam-sealed blanks 114 are individually removed from the magazine 18 by the feeder and loading mechanism 20, causing the flat blank to open into a double open-ended tubular blank 116 (FIG. 2*b*) prior to being placed on the mandrel 16 at the 12:00 o'clock position. The feeder and loading mechanism loads the tubular blank 116 onto the adjacent mandrel 16 such that the outermost four end closure panels 90, 92, 94 and 96 extend beyond the end face 58 of the mandrel 16, aligned with the respective side panels 70, 72, 74 and 76 to which the panels are connected by score lines 66*b*, 66*c*, 66*d* and 66*a*, respectively. With respect to the frame 12, the cover panel 94 is adjacent the frame, the front panel 96 is outboard of the frame, and the panels 92 and 90 are leading and trailing, respectively.

Figure 3:
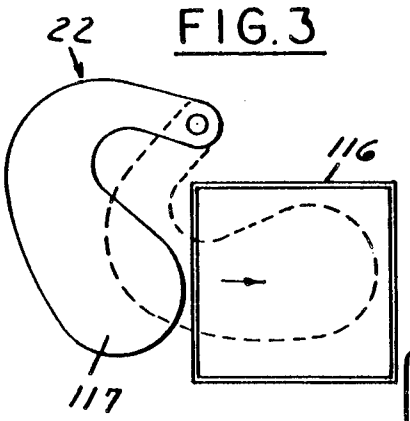
FIG. 3 is a perspective view of a portion of the FIG. 1 machine operable upon the trailing carton end panel.
Figure 4A:
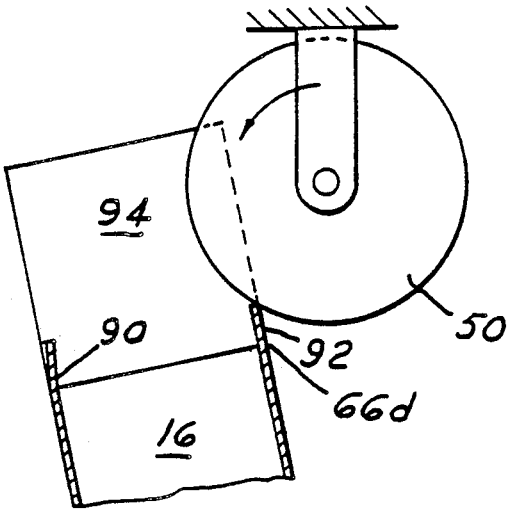
FIGS. 4*a*, 4*b* and 4*c* are side elevational views of the FIG. 4 portion of the machine in various operational conditions of closing the leading and trailing carton end panels.
Figure 4B:
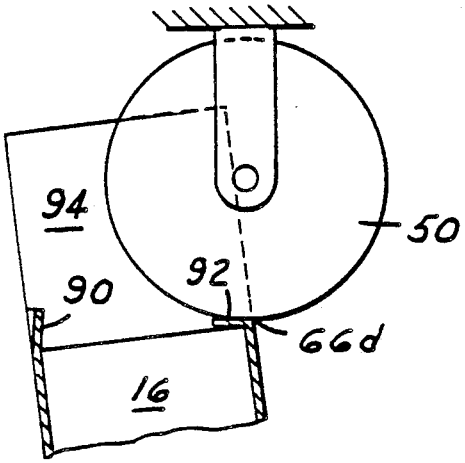

As soon as the tubular blank 116 is loaded onto the mandrel 16, the pre-breaker unit 22, consisting of arcuate shaped member 117 (FIG. 3) pivotally mounted at one end thereof, pivots into contact with the trailing end panel 90 from behind (FIG. 3) to provide an initial break of the panel about the adjacent score line 66*b* to facilitate the following folding of the panel. Substantially coincident with the pivoting of the pre-breaker unit 22, the turret mechanism 14 indexes in a clockwise direction from the 12:00 loading position. At approximately the 1:00 position, the extended leading panel 92 comes into the contact with the face of the roller 50 (FIG. 4*a*). If the roller 50 is at rest, the resistance of the panel 92 to being folded inwardly about the score line 66*d* imparts a rotating motion to the roller as the panel 92 is folded to the position shown in FIG. 4*b*.

Figure 4C:
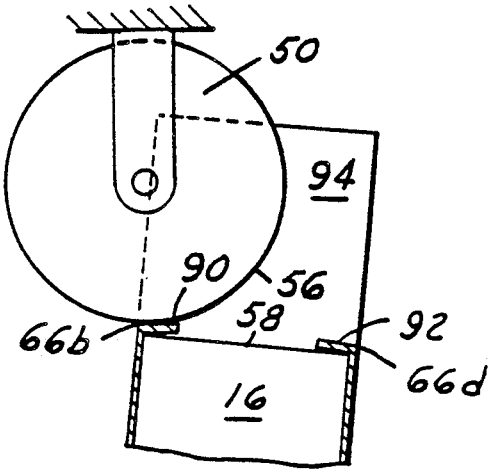

The now rotating roller 50 is contacted by the slightly forwardly bent trailing panel 90 of the tubular blank 116, and the inertia of the rotating roller is sufficient to rollingly engage the panel 90 and urge it forwardly with respect to the moving mandrel 16, and thus toward the center of the tubular blank 116 about the score line 66*b*, and into a suitable predetermined space, say 0.020", between the faces 56 and 58 of the roller 50 and the adjacent mandrel 16, respectively (FIG. 4*c*). One relationship between the roller 50 diameter and the mandrel face 58 width intermediate the leading and trailing panels 92 and 90 which produces this satisfactory result has been found to be approximately a 3 inch roller diameter and a 2 inch mandrel face width.

Due to the proximity of the face 56 of the roller 50 to the end face 58 of an adjacent mandrel 16, continued clockwise rotation of the mandrel causes each of the leading and trailing panels 92 and 90 to completely close about their respective score lines 66*d* and 66*b*, within the 0.020" space, as shown in FIG. 4*c*, while the side panels 94 and 96 continue to extend substantially aligned with their adjacent side panels 68 and 72. However, since the panels 94 and 96 are connected to the panels 92 and 90 via the respective corner gussets 101, 103, 105 and 107, the panels 94 and 96 will be urged into contact with the side faces of the roller 50 (FIG. 4), when the latter flattens the panels 92 and 90.

The guide mechanism 26 located at approximately the 2:00 o'clock position includes two oppositely disposed fluid-actuated cylinders 118 supported on respective standoffs 119 secured to a bracket 120 mounted on the machine 10. A pair of oppositely disposed notched folding units 122 are connected to the pistons 124 of the respective cylinders 118. An intermediate wall member 126 is secured to the bracket 120.

Figure 5:
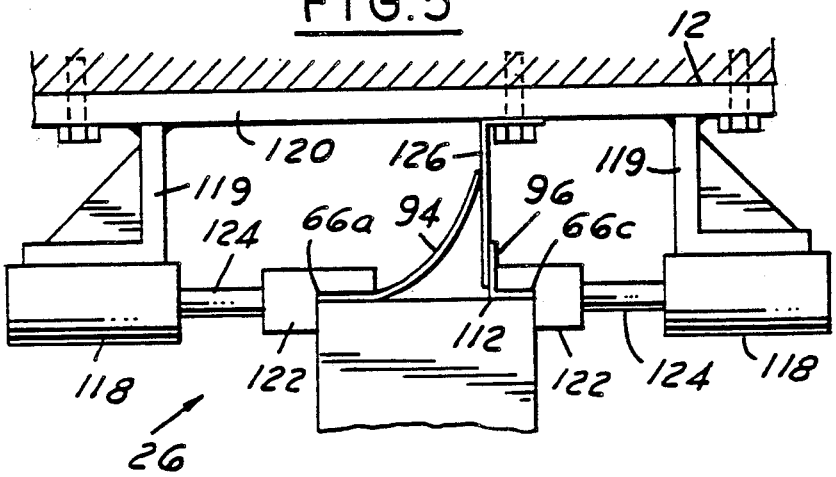

As shown in FIG. 5, the notched folding units 122 serve to the fold the side panels 94 and 96 about the respective score line 66*a* and 66*c*, with the cover panel 94 overlying the corner gussets 101 and 105 and one side of the wall member 126, and the side panel 96 folding such that the fold-in segment 108 overlies the corner gussets 103 and 107, and the panel portions 110*a* and 110*b* lies against the other side of the wall member 116.

The folding mechanism 28 includes folding members 128 and 130 for folding the cover panel 94 and the panel portion 110*a* downwardly onto the leading and trailing panels 92 and 90, and onto the fold-in segment 108, as illustrated in FIG. 6. A support member 131 underlies the extended panel portion 110*b*.

Next, the sealing unit 30, which may consist of any suitable heating and sealing means such as vibratory horn member 132, (FIG. 7), seals the various folded together panels arriving from the previous folding mechanism 28. As noted in FIG. 7, the fold-over or lift tab portion 110*b* extends transverse to the side panel 72 and co-planar with the fold-out panel portion 11*a*.

This portion 110*b* is next urged upwardly (FIG. 8) by a folding rail 134 as it approaches the next station where the heating unit 32, which may be any suitable heater 136 selectively softens the outer thermoplastic coating of the adjacent edge portion of the cover panel 94.

Figure 2C:
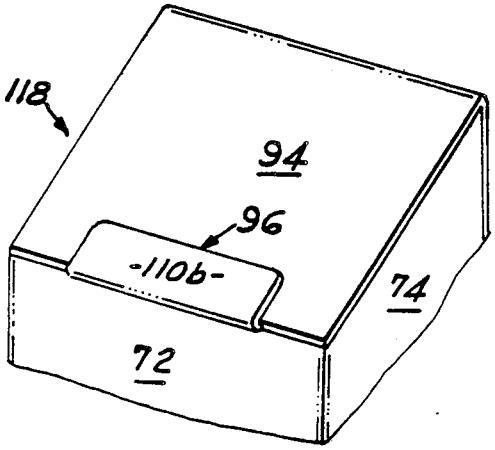

During the next indexing movement, as shown in FIG. 9, the lift tab 110*b* is urged by a further rail member 138 inwardly and downwardly onto the softened portion of the cover panel 94 to become tack-welded thereto, producing the completely closed end container 140 shown in FIG. 2*c*.

INDUSTRIAL APPLICABILITY

It should be apparent that the invention provides a simplified, yet efficient folding mechanism for folding the leading and trailing end panels of a carton mounted on a rotating mandrel.

It should also be apparent that the roller type folding mechanism is adaptable to end closure panels shaped differently than the illustrated and described panels 90, 92, 94 and 96.

While but one embodiment of the invention has been shown and described, other modifications thereof are possible within the scope of the following claims.

The embodiments of the invention in which an exclusive property of privilege is claimed are defined as follows:

1. For use with a rotating turret (14) having a plurality of radially extending mandrels including respective end faces and bearing an openended carton with a leading, a trailing, and two side closure panels extending beyond the end face of the mandrel substantially aligned with their respective body panels, a carton end panel closing mechanism characterized by a rotatable full round roller (50) having a peripheral face and fixedly mounted such that the face (56) of the roller is spaced a predetermined distance from the end face (58) of said mandrel as the latter rotates therepast, so as to be rotated by contact with said leading panel as it passes and to progressively fold same rearwardly until closed, and while continuing to rotate, to engage said trailing panel as it passes and to progressively fold same forwardly until closed.

2. The end panel closing mechanism described in claim 1 and pre-breaker means (117) for pre-breaking said trailing panel forwardly prior to said trailing panel contacting said toller.

3. The end panel closing mechanism described in claim 1, wherein corner gussets (105, 107, 101, 103 are formed on each end of each of the leading and trailing end panels adapted to fold onto their respective leading and trailing panels, and wherein the width of the face of the roller is approximately equal to the distance between the corner gussets on each panel.

4. The end panel closing mechanism described in claim 3, and side panel guiding means and folding means (26, 28) downstream of said roller for engaging and folding the side closure panels onto said leading and trailing closure panels.

5. The end panel closing mechanism described in claim 4, wherein said side panel guiding means includes oppositely disposed fluid cylinder-driven members (118, 124, 122) for folding inner portions of said side closure panels onto said respective corner gussets, and an intermediate wall member (126) for folding the end portions of one of said side closure panels into a vertical condition on one side of the wall member bowing the end portion of the other of said side closure panels outwardly from the leading and trailing closure panels on the other side of the wall member.

6. The end panel closing mechanism described in claim 5, wherein said side panel folding means includes a folding member (130) for folding said end portion of the other of said side closure panels onto said end portion of said one of said side closure panels, and the latter onto the inner portion of said one of said side closure panels.

7. The end panel closing mechanism described in claim 6, and sealing means (132) for sealing the side closure panels to the leading and trailing closure panels in a substantially flat configuration.

8. The end panel closing mechanism described in claim 6, wherein a portion of said side closure panels extends laterally beyond the plane of the adjacent body panel, and rail means (134) for folding said extended portion upwardly into a planar relationship with said body panel and heater means for selectively heating the outer surface of said other of said side closure panels adjacent said extended portion.

9. The end panel closing mechanism described in claim 8, and additional rail means (138) for folding said extended portion downwardly onto said heated surface to become tack welded thereto adapted to serve as a lift tab for subsequent opening of the end closure.

* * * * *